US007722324B2

(12) United States Patent
Cunha et al.

(10) Patent No.: US 7,722,324 B2
(45) Date of Patent: May 25, 2010

(54) MULTI-PERIPHERAL SERPENTINE MICROCIRCUITS FOR HIGH ASPECT RATIO BLADES

(75) Inventors: Francisco J. Cunha, Avon, CT (US); Matthew T. Dahmer, Auburn, MA (US)

(73) Assignee: United Technologies Corporation, Hartford, CT (US)

( * ) Notice: Subject to any disclaimer, the term of this patent is extended or adjusted under 35 U.S.C. 154(b) by 660 days.

(21) Appl. No.: 11/516,143

(22) Filed: Sep. 5, 2006

(65) Prior Publication Data

US 2008/0056909 A1 Mar. 6, 2008

(51) Int. Cl.
*F01D 5/08* (2006.01)

(52) U.S. Cl. ..... 416/97 R

(58) Field of Classification Search ..... 416/97 R
See application file for complete search history.

(56) References Cited

U.S. PATENT DOCUMENTS

| | | | | |
|---|---|---|---|---|
| 3,849,025 | A * | 11/1974 | Grondahl | 416/97 R |
| 5,931,638 | A * | 8/1999 | Krause et al. | 416/97 R |
| 6,264,428 | B1 * | 7/2001 | Dailey et al. | 416/97 R |
| 6,705,836 | B2 * | 3/2004 | Bourriaud et al. | 416/97 R |
| 2009/0104042 | A1 * | 4/2009 | Liang | 416/97 R |

* cited by examiner

*Primary Examiner*—Richard Edgar
(74) *Attorney, Agent, or Firm*—Bachman & LaPointe, P.C.

(57) ABSTRACT

A cooling arrangement for a pressure side of an airfoil portion of a turbine engine component is provided. The cooling arrangement comprises a pair of cooling circuits embedded within a wall forming the pressure side. The pair of cooling circuits includes a first serpentine cooling circuit and a second circuit offset from the first serpentine cooling circuit.

5 Claims, 4 Drawing Sheets

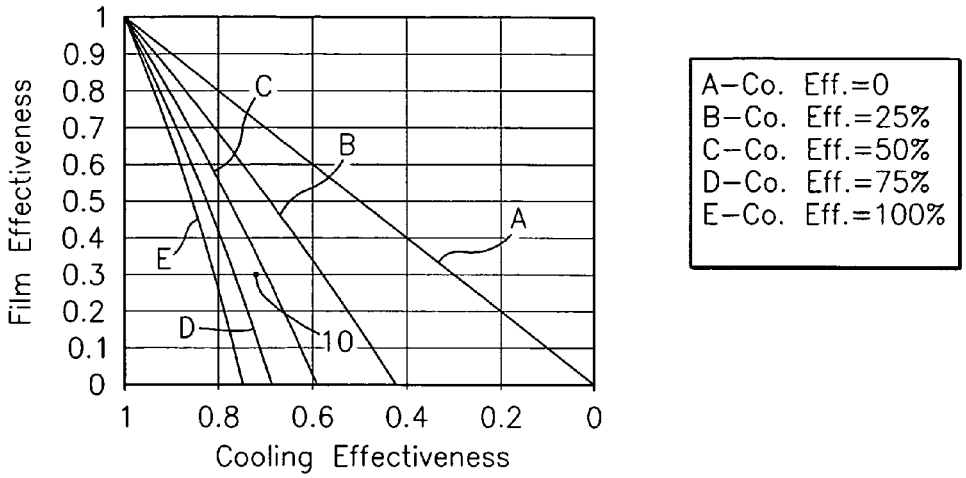
*FIG. 1*
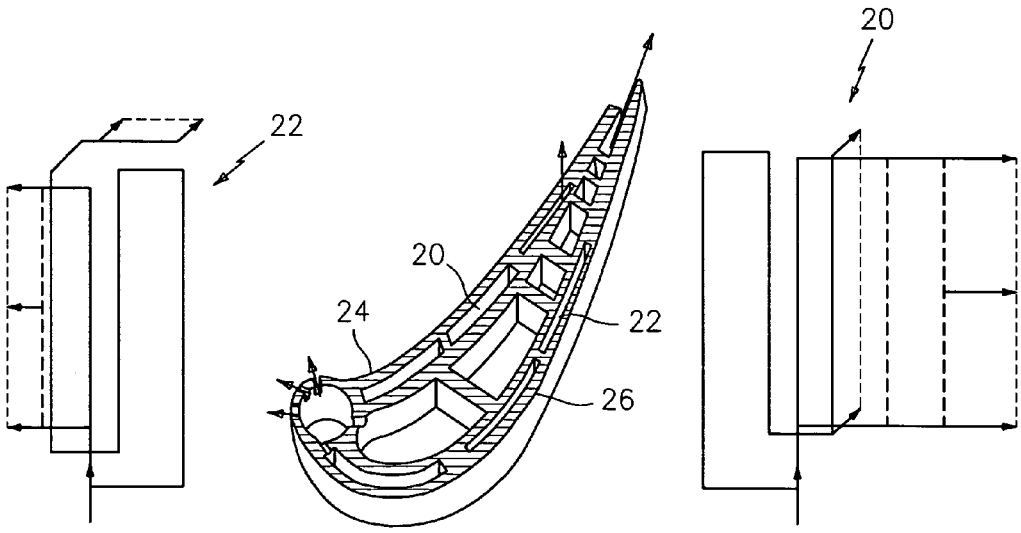
*FIG. 2C* *FIG. 2A* *FIG. 2B*

MULTI-PERIPHERAL SERPENTINE MICROCIRCUITS FOR HIGH ASPECT RATIO BLADES

BACKGROUND (1) Field of the Invention

The present invention relates to microcircuit cooling for the pressure side of a high aspect ratio turbine engine component, such as a turbine blade.

(2) Prior Art

The overall cooling effectiveness is a measure used to determine the cooling characteristics of a particular design. The ideal non-achievable goal is unity, which implies that the metal temperature is the same as the coolant temperature inside an airfoil. The opposite can also occur when the cooling effectiveness is zero implying that the metal temperature is the same as the gas temperature. In that case, the blade material will certainly melt and burn away. In general, existing cooling technology allows the cooling effectiveness to be between 0.5 and 0.6. More advanced technology such as supercooling should be between 0.6 and 0.7. Microcircuit cooling as the most advanced cooling technology in existence today can be made to produce cooling effectiveness higher than 0.7.

FIG. 1 shows a durability map of cooling effectiveness (x-axis) vs. the film effectiveness (y-axis) for different lines of convective efficiency. Placed in the map is a point 10 related to a new advanced serpentine microcircuit shown in FIGS. 2A-2C. This serpentine microcircuit includes a pressure side serpentine circuit 20 and a suction side serpentine circuit 22 embedded in the airfoil walls 24 and 26.

The Table I below provides the dimensionless parameters used to plot the design point in the durability map.

TABLE I

| Operational Parameters for serpentine microcircuit | |
|---|---|
| beta | 2.898 |
| Tg | 2581 [F.] |
| Tc | 1365 [F.] |
| Tm | 2050 [F.] |
| Tm_bulk | 1709 [F.] |
| Phi_loc | 0.437 |
| Phi_bulk | 0.717 |
| Tco | 1640 [F.] |
| Tci | 1090 [F.] |
| eta_c_loc | 0.573 |
| eta_f | 0.296 |
| Total Cooling Flow | 3.503% |
| WAE | 10.8 |

Legend for Table I
Beta = dimensionless heat load parameter or ratio of convective thermal load to external thermal load
Phi_loc = local cooling effectiveness
Phi_bulk = bulk cooling effectiveness
Eta_c_loc = local cooling efficiency
Eta_f = film effectiveness
Tg = gas temperature
Tc = coolant temperature
Tm = metal temperature
Tm_bulk = bulk metal temperature
Tco = exit coolant temperature
Tci = inlet coolant temperature
WAE = compressor engine flow, pps It should be noted that the overall cooling effectiveness from the table is 0.717 for a film effectiveness of 0.296 and a convective efficiency (or ability to pick-up heat) of 0.573 (57%). It should also be noted that the corresponding cooling flow for a turbine blade having this cooling microcircuit is 3.5% engine flow. FIG. 3 illustrates the cooling flow distribution for a turbine blade with the serpentine microcircuits of FIGS. 2*a*-2*c* embedded in the airfoils walls.

The design shown in FIGS. 2*a*-2*c* leads to significant cooling flow reduction. This in turn has positive effects on cycle thermodynamic efficiency, turbine efficiency, rotor inlet temperature impacts, and specific fuel consumption.

It should be noted from FIG. 3 that the flow passing through the pressure side serpentine microcircuit is 1.165% WAE in comparison with 0.428% WAE in the suction side serpentine microcircuit for this arrangement. This represents a 2.7 fold increase in cooling flow relative to the suction side microcircuit. The reason for this increase stems from the fact that the thermal load to the part is considerably higher for the airfoil pressure side. As a result, the height of the microcircuit channel should be a 1.8 fold increase over that of the suction side.

Besides the increased flow requirement on the pressure side, the driving pressure drop potential in terms of source to sink pressures for the pressure side circuit is not as high as that for the suction side circuit. In considering the coolant pressure on the pressure side circuit, FIG. 4 shows that at the end of the third leg, the back flow margin, as a measure of internal to external pressure ratio, is low. As a consequence of this back flow issue, the metal temperature increase beyond that required metal temperature close to the third leg of the pressure side circuit. A remedy is needed to eliminate this problem on the aft pressure side of the airfoil.

SUMMARY OF THE INVENTION

The present invention relates to microcircuit cooling for the pressure side of a high aspect ratio turbine engine component. The term "aspect ratio" may be defined as the ratio of airfoil span (height) to axial chord.

In accordance with the present invention, there is provided a cooling arrangement for a pressure side of an airfoil portion of a turbine engine component. The cooling arrangement broadly comprises a pair of cooling circuits embedded within a wall forming the pressure side, and the pair of cooling circuits comprises a first serpentine cooling circuit and a second circuit offset from the first serpentine cooling circuit.

Further, in accordance with the present invention, there is provided a turbine engine component broadly comprising an airfoil portion having a pressure side and a suction side and a pair of cooling circuits embedded within a wall forming the pressure side. The pair of cooling circuits comprises a first serpentine cooling circuit and a second circuit offset from the first serpentine cooling circuit.

Other details of the multi-peripheral serpentine microcircuits for high aspect ratio blades of the present invention, as well as other objects and advantages attendant thereto, are set forth in the following detailed description and the accompanying drawings wherein like reference numerals depict like elements.

BRIEF DESCRIPTION OF THE DRAWINGS

FIG. 1 is a graph showing cooling effectiveness versus film effectiveness for a turbine engine component;

FIG. 2A shows an airfoil portion of a turbine engine component having a pressure side cooling microcircuit embedded in the pressure side wall and a suction side cooling microcircuit embedded in the suction side wall;

FIG. 2B is a schematic representation of a pressure side cooling microcircuit used in the airfoil portion of FIG. 2A;

FIG. 2C is a schematic representation of a suction side cooling microcircuit used in the airfoil portion of FIG. 2A;

DETAILED DESCRIPTION OF THE PREFERRED EMBODIMENT(S)

Figure 5:
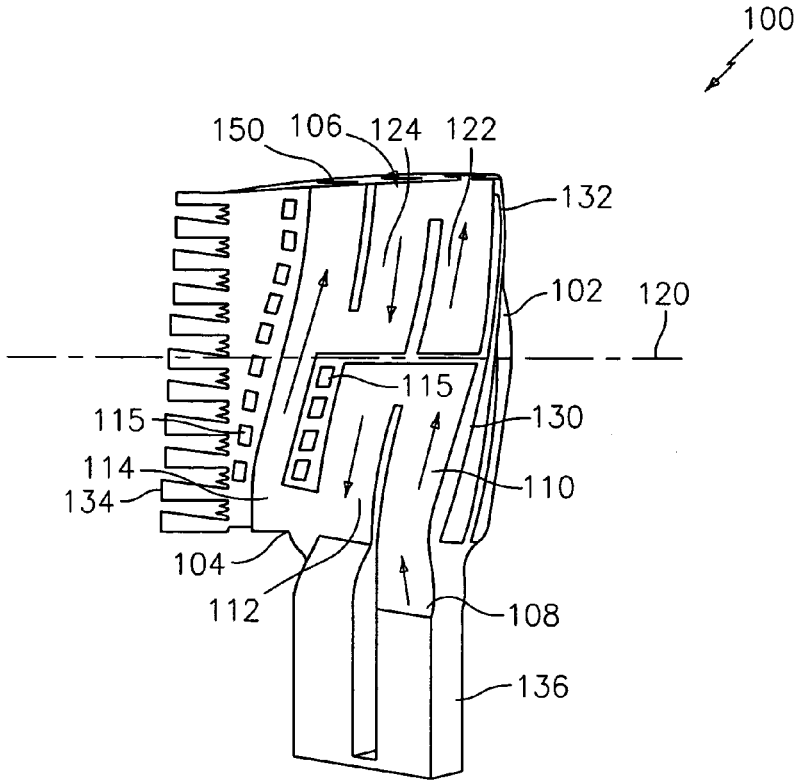
FIG. 5 is a schematic representation of a pressure side cooling scheme in accordance with the present invention.

Referring now to FIG. 5, there is shown a schematic representation of pressure side cooling scheme for a turbine engine component 100, such as a turbine blade, having an airfoil portion 102. As can be seen from this figure, the pressure side of the airfoil portion 102 is provided with two peripheral serpentine circuits 104 and 106 offset radially from each other to minimize the heat pick-up in each circuit. Film cooling is provided separately by shaped holes from the main core cavities. The circuits 104 and 106 are embedded within the pressure side wall.

The first circuit 104 has an inlet 108 for receiving a flow of cooling fluid from a source (not shown). The cooling fluid flows from the inlet 108 into a first leg 110 and then into a second leg 112. From the second leg, the cooling fluid flows into a third or outlet leg 114 through one or more tip holes 150. As can be seen from FIG. 5, the first two legs 110 and 112 of the cooling circuit are only present in a lower span of the airfoil portion 102, i.e, below the mid-span line 120 for the airfoil portion 102.

The circuit 106 is formed in the upper span of the airfoil portion 102, i.e. above the mid-span line 120. The circuit 106 has a first leg 122 which has an inlet which communicates with an internal supply cavity (not shown). Cooling fluid from the first leg 122 flows into a second leg 124 and then into the outlet leg 114. Thus, the upper part of the pressure side is convectively cooled.

Figure 3:
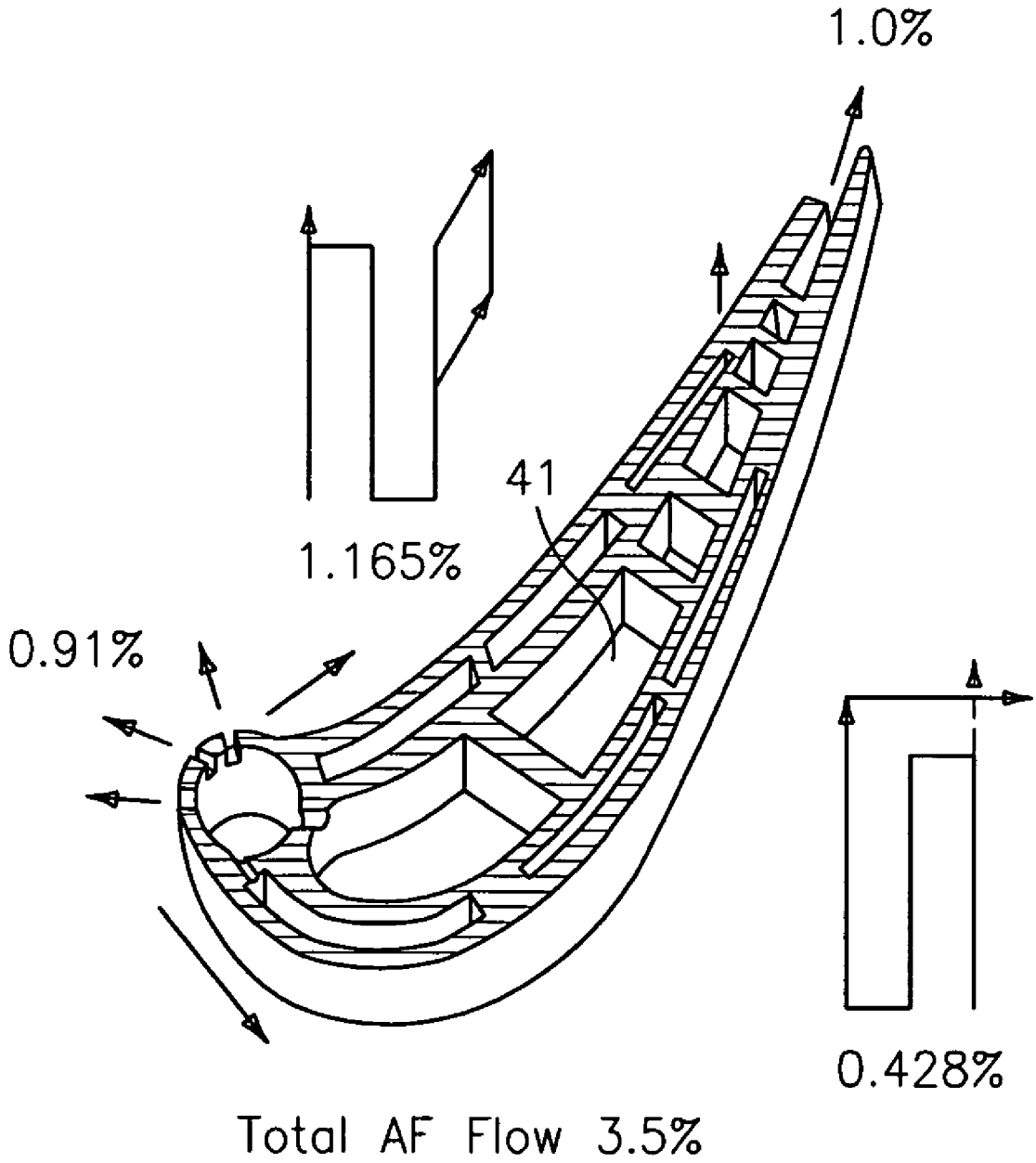
FIG. 3 illustrates the cooling flow distribution for a turbine engine component with serpentine microcircuits embedded in the airfoil walls.
Figure 4:
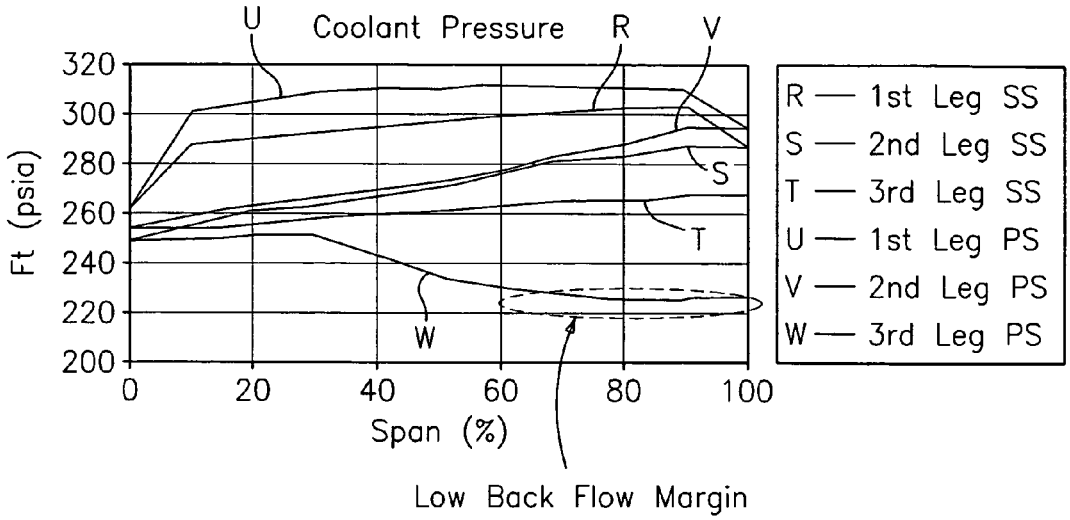
FIG. 4 is a graph illustrating the low back flow margin for the third leg of the pressure side circuit of FIG. 2B.

The cooling scheme as shown in this embodiment, also includes a plurality of film cooling holes 115. The film cooling holes may be used to form a film of cooling fluid over external surfaces of the pressure side including a trailing edge portion. The film cooling holes 115 may be supplied with cooling fluid via one or more main core cavities such as one or more of cavities 41 shown in FIG. 3.

The cooling circuits 104 and 106 may be formed using any suitable technique known in the art. For example, the circuits may be formed using a combination of refractory metal core technology and silica core technology. For example, refractory metal cores may be used to from the lower span peripheral core 130 and the upper span peripheral core 132, while silica cores may be used to form the trailing edge structure 134 and the airfoil main body 136.

Figure 6:
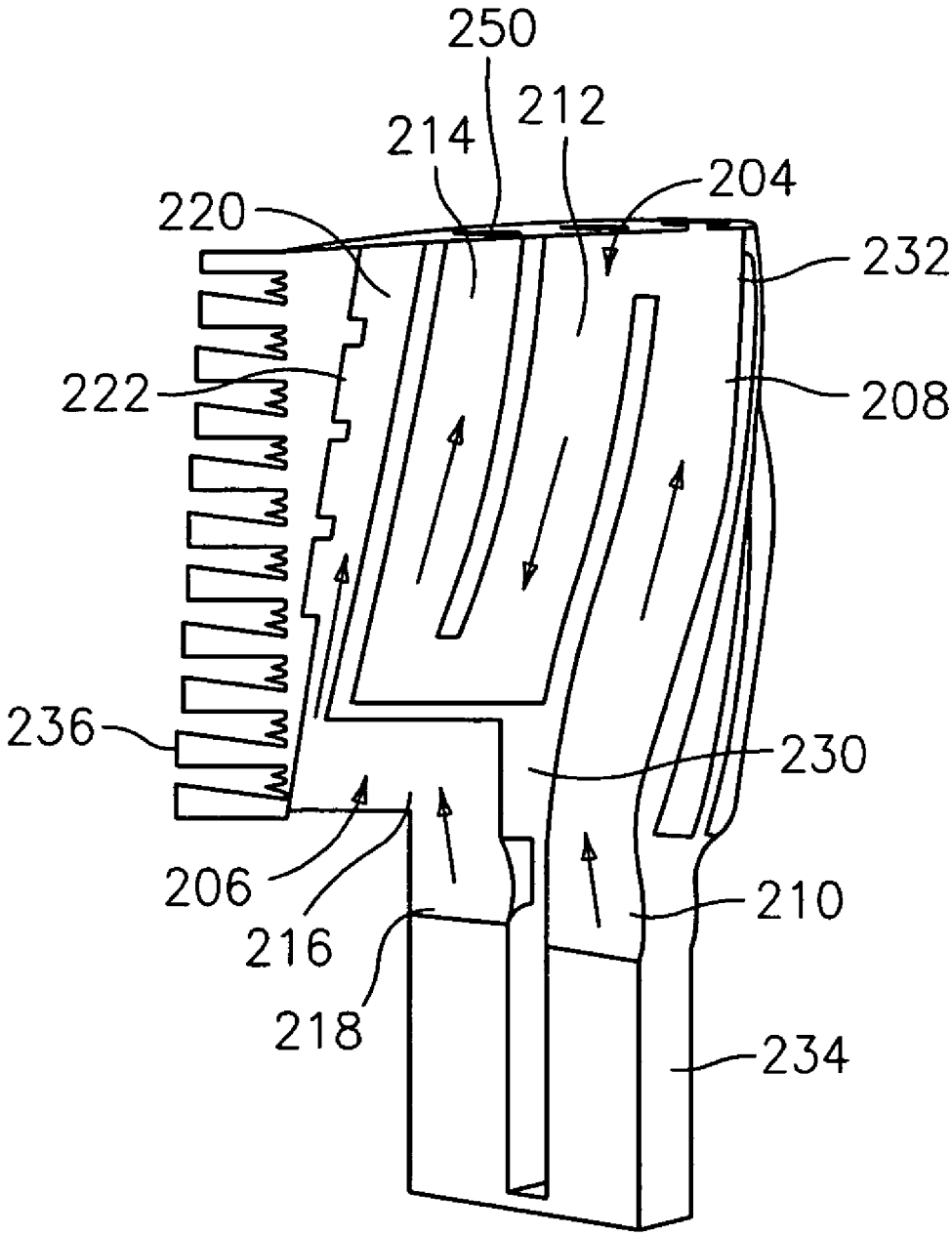
FIG. 6 is a schematic representation of an alternative pressure side cooling scheme in accordance with the present invention.

Referring now to FIG. 6, there is shown another cooling scheme for the pressure side of an airfoil portion of a turbine engine component. In this scheme, the pressure side is provided with a first cooling circuit 204 and a second cooling circuit 206. The first cooling circuit 204 is a serpentine cooling circuit having an inlet leg 208 which communicates with an inlet 210 which in turn communicates with a source of cooling fluid (not shown). The inlet leg 208 extends along the lower and upper span of the airfoil portion and communicates with a second leg 212 which in turn communicates with an third or outlet leg 214. The cooling fluid exits the outlet leg 214 through one or more tip holes 250. The cooling circuit 206 has an inlet leg 216 which communicates with a trailing edge inlet 218 which is separate from the inlet 210. The inlet leg 216 provides cooling fluid to a radially extending outlet leg 220 which extends over the lower and upper spans of the airfoil portion. A plurality of film slots 222 may be provided so that cooling fluid from the outlet leg 220 flows over the pressure side of the airfoil portion 102.

The cooling circuits 204 and 206 may be formed using any suitable technique known in the art. For example, the cooling circuits 204 and 206 may be formed using refractory metal cores for the lower span 230 and the upper span 232. Silica cores may be used to form the main body core 234 and the trailing edge silica core 236.

The suction side of the airfoil portion 102 may be provided with an embedded serpentine cooling circuit such as that shown in FIG. 2C.

In both pressure side cooling arrangements shown in FIGS. 5 and 6, the heat pick-up is minimized and, as a result, these peripheral cooling arrangements can be used for blades with higher aspect ratios and increased surface area. In these arrangements, the circuits are also shorter which reduces the pressure drop associated with each circuit. As the radial height of each circuit is minimized, the straight portions of the circuits are minimized, whereas the turning portions of the circuits are increased. This leads to higher internal heat transfer coefficients without the need for heat transfer augmentation.

It is apparent that there has been provided in accordance with the present invention multi-peripheral serpentine microcircuits for high aspect ratio blades which fully satisfy the objects, means, and advantages set forth hereinbefore. While the present invention has been described in the context of specific embodiments thereof, other unforeseeable alternatives, modifications, and variations may become apparent to those skilled in the art having read the foregoing detailed description. Accordingly, it is intended to embrace those alternatives, modifications, and variations as fall within the broad scope of the appended claims.

What is claimed is:

1. A cooling arrangement for a pressure side of an airfoil portion of a turbine engine component comprising:

a pair of cooling circuits embedded within a wall forming said pressure side;

said pair of cooling circuits comprising a first serpentine cooling circuit and a second circuit offset from said first serpentine cooling circuit, said pair of cooling circuits having a common outlet leg and said outlet leg extending in a spanwise direction from a lower span of said airfoil portion to an upper span of said airfoil portion.

2. The cooling arrangement of claim 1, wherein said first serpentine cooling circuit is located in said lower span of said airfoil portion and said second circuit is located in said upper span of said airfoil portion.

3. The cooling arrangement of claim 2, wherein said second cooling circuit comprises a serpentine arrangement having a second inlet leg communicating with an intermediate leg and said intermediate leg communicating with said outlet leg of said first cooling circuit.

4. The cooling arrangement of claim 1, wherein said first serpentine cooling circuit has a first inlet leg, a second leg communicating with said inlet leg, and said outlet leg communicating with said second leg.

5. The cooling arrangement of claim 1, further comprising a plurality of film cooling holes for distributing cooling fluid over an external surface of the pressure side.

* * * * *